US005528789A

United States Patent [19]

Rostamo

[11] Patent Number: 5,528,789

[45] Date of Patent: Jun. 25, 1996

[54] ROBOTIC DUCT CLEANING APPARATUS

[75] Inventor: Gary Rostamo, Benbrook, Tex.

[73] Assignee: Steamatic, Inc.

[21] Appl. No.: 372,813

[22] Filed: Dec. 23, 1994

[51] Int. Cl.[6] ..... B08B 9/04

[52] U.S. Cl. ..... 15/104.12; 15/104.09; 15/395

[58] Field of Search ..... 15/104.05, 104.09, 15/104.12, 104.13, 104.14, 104.31, 304, 316.1, 395

[56] References Cited

U.S. PATENT DOCUMENTS

| | | | |
|---|---|---|---|
| 3,004,278 | 10/1961 | Stanley | 15/104.09 |
| 3,056,155 | 10/1962 | Harmes | 15/104.12 |
| 3,058,137 | 10/1962 | Doyle et al. | 15/104.12 |
| 3,078,823 | 2/1963 | Cummings et al. | 15/104.09 |
| 3,800,358 | 4/1974 | Ryan | 15/312.1 |
| 4,027,349 | 6/1977 | Clavin | 15/104.12 |
| 4,244,296 | 1/1981 | Vertut | 15/104.05 |
| 5,020,188 | 6/1991 | Walton | 15/406 |
| 5,072,487 | 12/1991 | Walton | 15/304 |
| 5,311,641 | 5/1994 | Matsuura et al. | 15/316.1 |
| 5,317,782 | 6/1994 | Matsuura et al. | 15/304 |
| 5,347,677 | 9/1994 | Prentice | 15/395 |
| 5,377,381 | 1/1995 | Wilson | 15/104.09 |
| 5,416,944 | 5/1995 | Ericksson | 15/104.09 |

FOREIGN PATENT DOCUMENTS

| | | | |
|---|---|---|---|
| 2094926 | 9/1982 | United Kingdom | 15/104.12 |

*Primary Examiner*—Mark Spisich
*Attorney, Agent, or Firm*—Arthur F. Zobal

[57] ABSTRACT

The cleaning apparatus has a body with two wheels on opposite sides of the body which are driven by two electric motors for moving the body forward or rearward or for turning the body. A cleaning device which uses pressurized air is supported by the body for providing a cleaning function for cleaning the inside of the duct. The cleaning device is supported by a support member. Another electric motor is employed for moving the support member upward and downward. Lights and a video camera are located at the front of the body for allowing the duct to be monitored and inspected by way of a remote video screen. Electrical leads are coupled to the motors to the lights and to the camera for remote control purposes. A conduit is coupled to the cleaning device for supplying air under pressure to the cleaning device.

26 Claims, 9 Drawing Sheets

143
33H
33F
145
33
141
77
73
57
53
151
457
451
179
29H
453
29F
25
181
166
27F
27H
97
87
67
75
55
85
65
83
63
71
81
61
51
S1
243
179
31F
31H
S2
S3
177
165
175
163
161

AIR COMPRESSOR
VIDEO MONITOR
VCR
12 VDC
POWER SUPPLY
S1
S2
S3
S4
L1
L2
L3
L4
L5
L6
L7
L8
R1
R2
R3
R4
R5
R6
R7
R8
175
165A
151
173
153
165
161
221
245
361
363
255
351M
351T2
351T1
351
353
365
357M
357
353M
351T
213
353T
243
241
355M
355T1
355
211
253
367
355T2
251
233B
235
(-)
(+)
223A
221A
231B
239
201
203
271
261
263
267
247
273
265

ROBOTIC DUCT CLEANING APPARATUS

BACKGROUND OF THE INVENTION

The invention relates to a remote controlled apparatus for cleaning air ducts.

FIELD OF THE INVENTION

There are many prior art devices for cleaning the inside of air ducts. Some of these devices use rotating brushes etc. driven by an elongated cable rotatably extending through a flexible robe or an air source or motor coupled to a flexible tube and wherein the tube is inserted into the duct and is used for vacuum purposes.

Although some of these devices are satisfactory for small round ducts, they have problems in cleaning large ducts since the rotational momentum of the rotating brush tends to maintain the brush on one side of the duct making it more difficulty to clean the other side thereof. Moreover, these devices have no provisions for inspecting the inside of the duct being cleaned.

SUMMARY OF THE INVENTION

It is an object of the inventor to provide a duct cleaning apparatus which is useful for cleaning large ducts and which includes means for lateral control and inspection and monitoring the inside of the duct being cleaned.

The invention comprises a body with wheels for use for moving the body in a duct. Electrical power means supported by the body is coupled to the wheels for moving the body. Cleaning means is supported by the body for providing a cleaning function for cleaning the inside of the duct. In the preferred embodiment air under pressure is provided to the cleaning means for use for allowing the cleaning means to provide the cleaning function. Electrical leads are coupled to the electrical power means for remote control purposes. A conduit is coupled to the cleaning means for supplying air under pressure to the cleaning means.

In one aspect the electrical power means may be operated to move the body forward and rearward and to turn the body in the duct.

In another aspect, there is provided a movable means remotely controlled for moving the cleaning means upward or downward relative to the body.

In a further aspect, a light and a video camera are located at the front of the body for allowing the inside of the duct to be monitored and inspected by way of a remote video screen.

DESCRIPTION OF THE PREFERRED EMBODIMENTS

Figure 1:
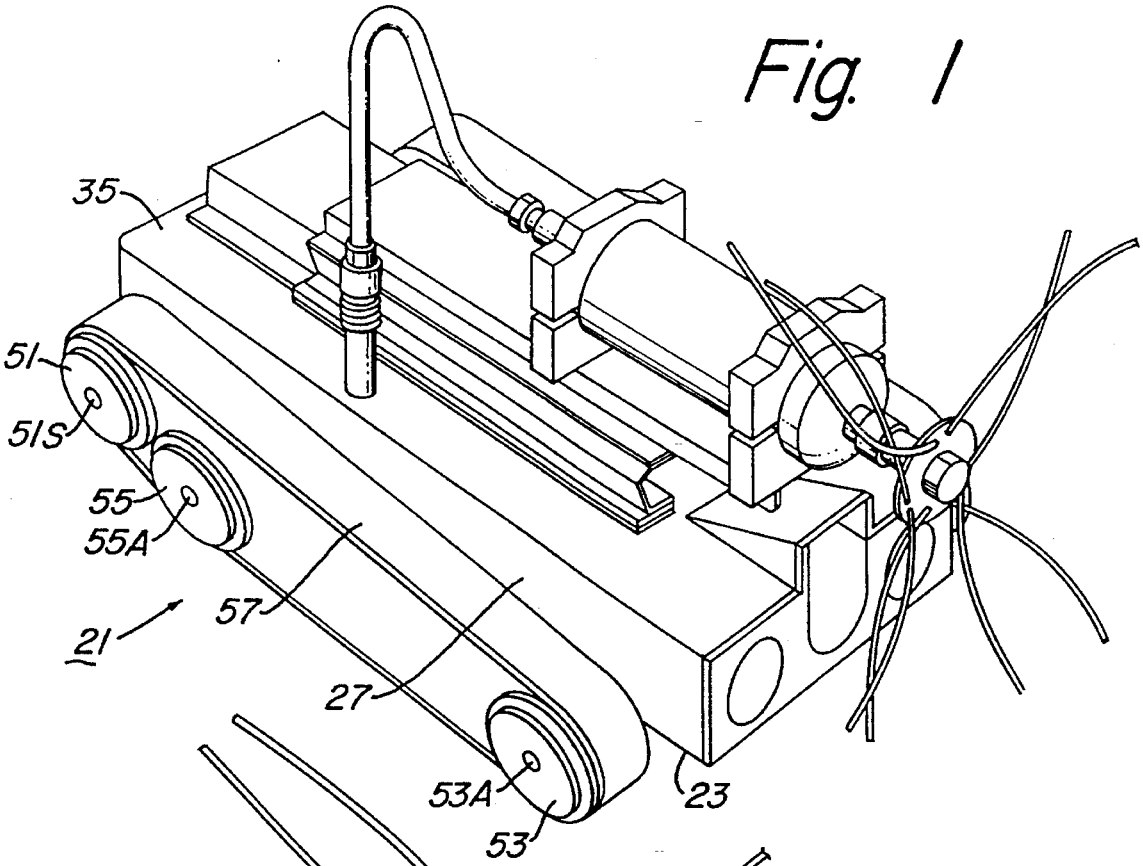
FIG. 1 is an isometric view of the cleaning apparatus of the invention adapted to be located in a duct.
Figure 2:
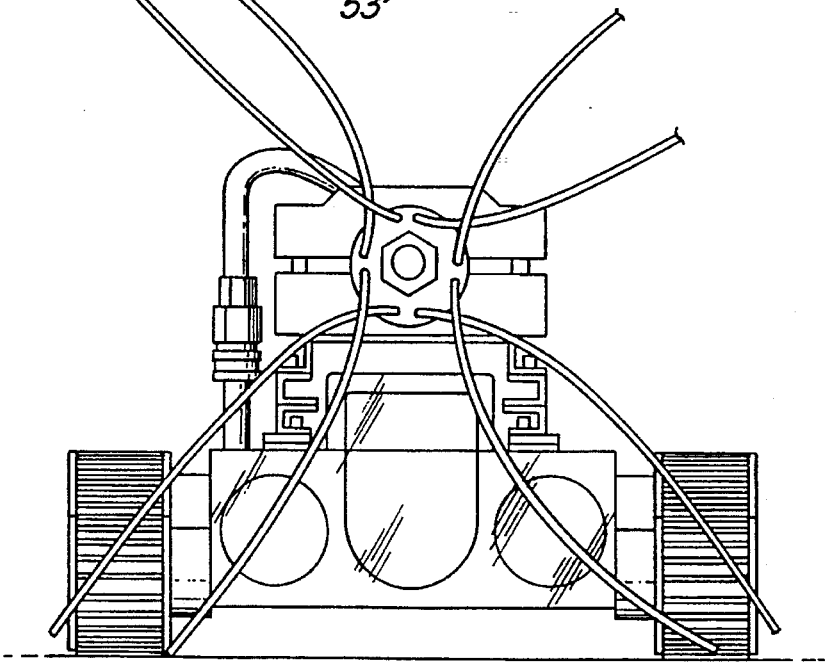
FIG. 2 is a front view of the apparatus of FIG. 1.
Figure 3:
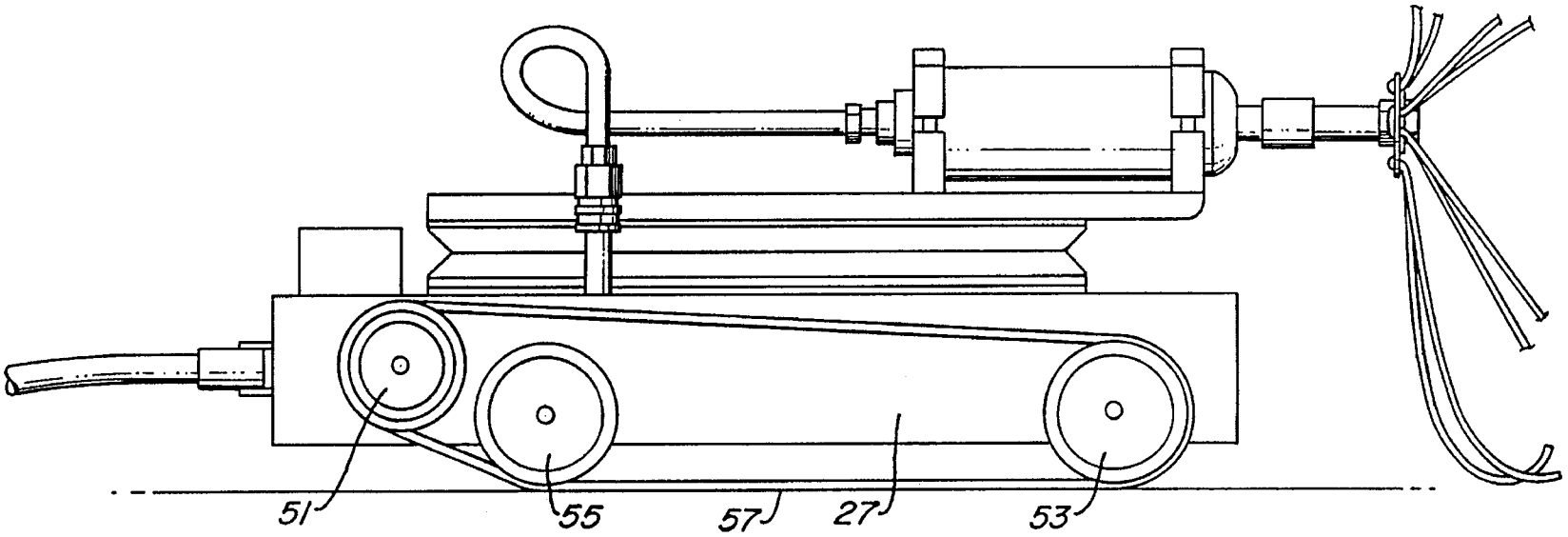
FIG. 3 is a right side view of the apparatus of FIG. 1.
Figure 4:
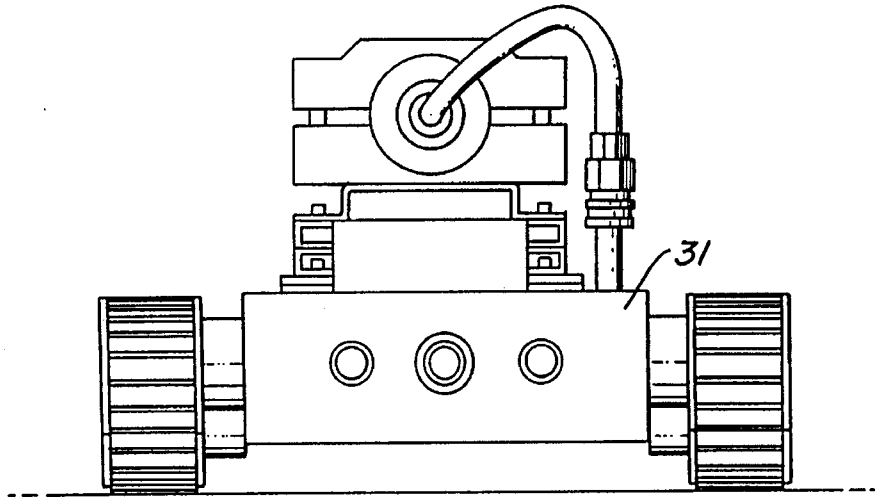
FIG. 4 is a rear view of the apparatus of FIG. 1.

Referring now to FIGS. 1–6 of the drawings, the apparatus of the invention for entering for cleaning the inside wall of the duct is identified by reference numeral 21. It may be used to clean large air ducts used in buildings, homes, etc. which are rectangular, square, circular, or elliptical in cross section. The apparatus 21 comprises a metal panshaped member 23 having a bottom wall 25, two side walls 27 and 29, a rear wall 31, a front wall 33 and a removable metal top wall 35 forming a structural body. The upper ends of the walls 27, 29, 31, and 33 have flanges 27F, 29F, 31F and 33F with threaded holes 27H, 29H, 31H and 33H for receiving bolts 41 which extend through holes 35H of top wall 35 for removably attaching the top wall 35 to walls 27, 29, 31, and 33.

Located on the right side of the body 23, 35 are a rear rotatably driven wheel 51, a rotatable non-driven front wheel 53 and a rotatable non-driven intermediate wheel 55 all of which have teeth (not shown on all wheels) for supporting a continuous track 57 for rotation. The track 57 has teeth on its inside which mesh with the teeth of wheels 51, 53, and 55. Track 57 is formed of a suitable flexible plastic material. Axles 53A and 55A secured to the wall 27 support the wheels 53 and 55 for rotation. Wheel 51 is connected to a shaft 51S which extends through the wall 27 and is secured to a gear 61, having teeth which mesh with teeth of a gear 63 connected to a shaft 65 which is rotated by a reversible electric motor 67.

Located on the left side of the body 23, 35 are a rear rotatably driven wheel 71, a rotatable non-driven front wheel 73, and a rotatable non-driven intermediate wheel 75 all of which have teeth (not shown) for supporting a continuous track 77 for rotation. The track 77 has teeth on its inside which mesh with the teeth of wheels 71, 73, and 75. Track 77 is formed of a suitable flexible plastic material. Axles 73A and 75A secured to the wall 29 support the wheels 73 and 75 for rotation. Wheel 71 is connected to a shaft 71S which extends through the wall 29 and is secured to a gear 81 which meshes with a gear 83 connected to a shaft 85 which is rotated by a reversible electric motor 87.

The tracks 57 and 77 are used since they provide more friction than the use of only wheels for moving the apparatus 21 in a duct.

The motors 67 and 87 may be rotated together in first and second opposite directions respectively to rotate the wheels 51 and 71 and hence the tracks 57 and 77 in directions to move the apparatus in forward or rearward directions respectively. In addition while the track 57 is stationary, track 77 can be rotated in a forward or rearward direction to cause the apparatus to turn and similarly while track 77 is stationary, track 57 can be rotated in a forward or rearward direction to cause the apparatus to turn.

Figure 13:
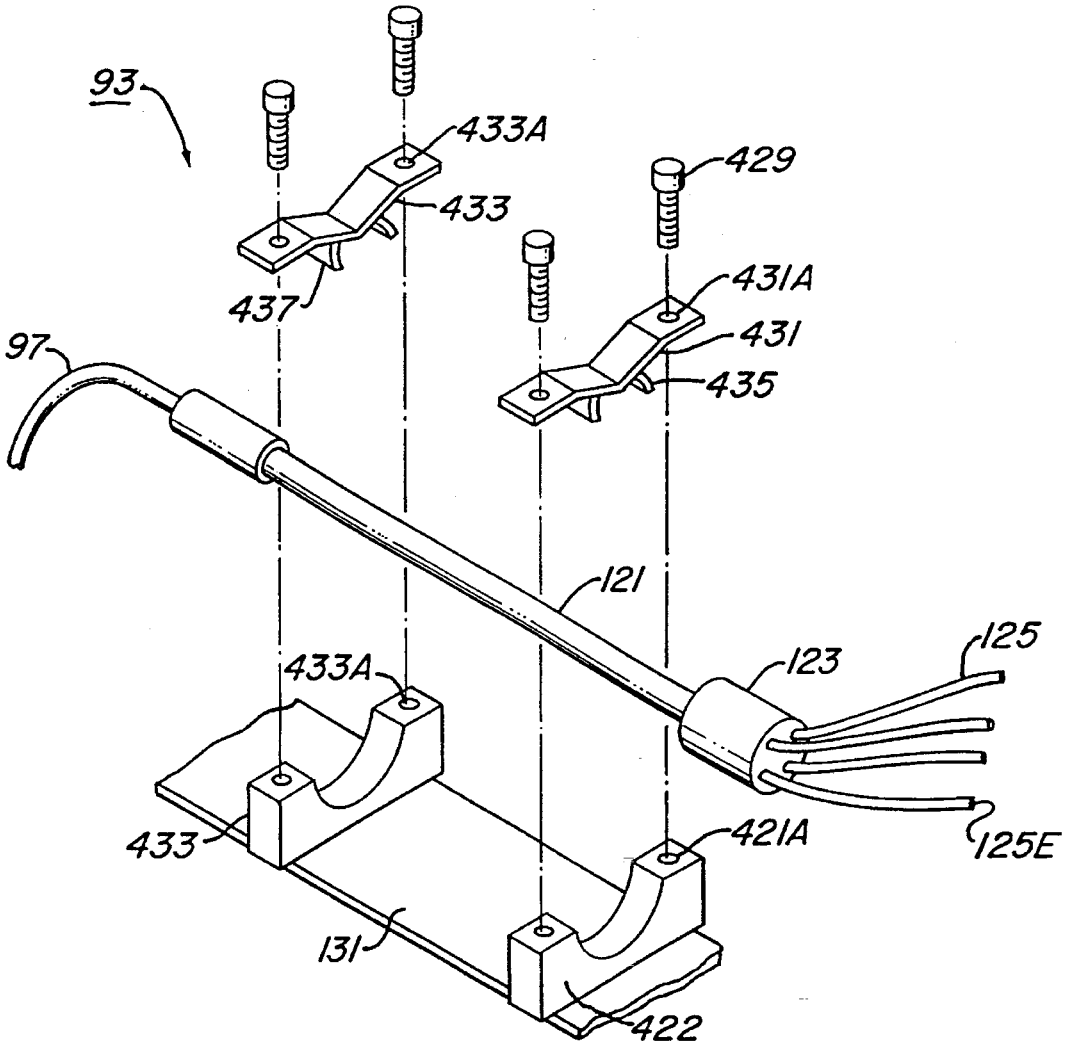
FIG. 13 is another type of cleaning device using air under pressure which may be used instead of the rotating strands of FIGS. 1–6.

The apparatus can support several types of cleaning devices such as that shown at 91 in FIGS. 1–6 or that shown at 93 in FIG. 13. The device 91 comprises an air motor 95 which uses air under pressure suppled by a conduit 97 for rotating a shaft 99 with a head 101 to which flexible plastic lines 103 are attached for engaging and cleaning the wall of the duct. The device 93 of FIG. 13 comprises a tube 121 having a hollow head 123 to which the ends of flexible tubes 125 are attached. Air under pressure is supplied to the tube 121 which is applied to the tubes 125 by way of the head 123. The air passes from the ends 125E of the tubes 125 which causes the tubes to flop about the head 123 for engaging the wall of the duct and for blowing air for cleaning the duct wall. The devices 91 or 93 are removably supported to a platform 131 which is secured to a scissors mechanism 133 which may be elevated or lowered by a reversible electric motor 135 (See FIGS. 8 and 9) located in a cover 137 and secured to the top wall 35.

Figure 5:
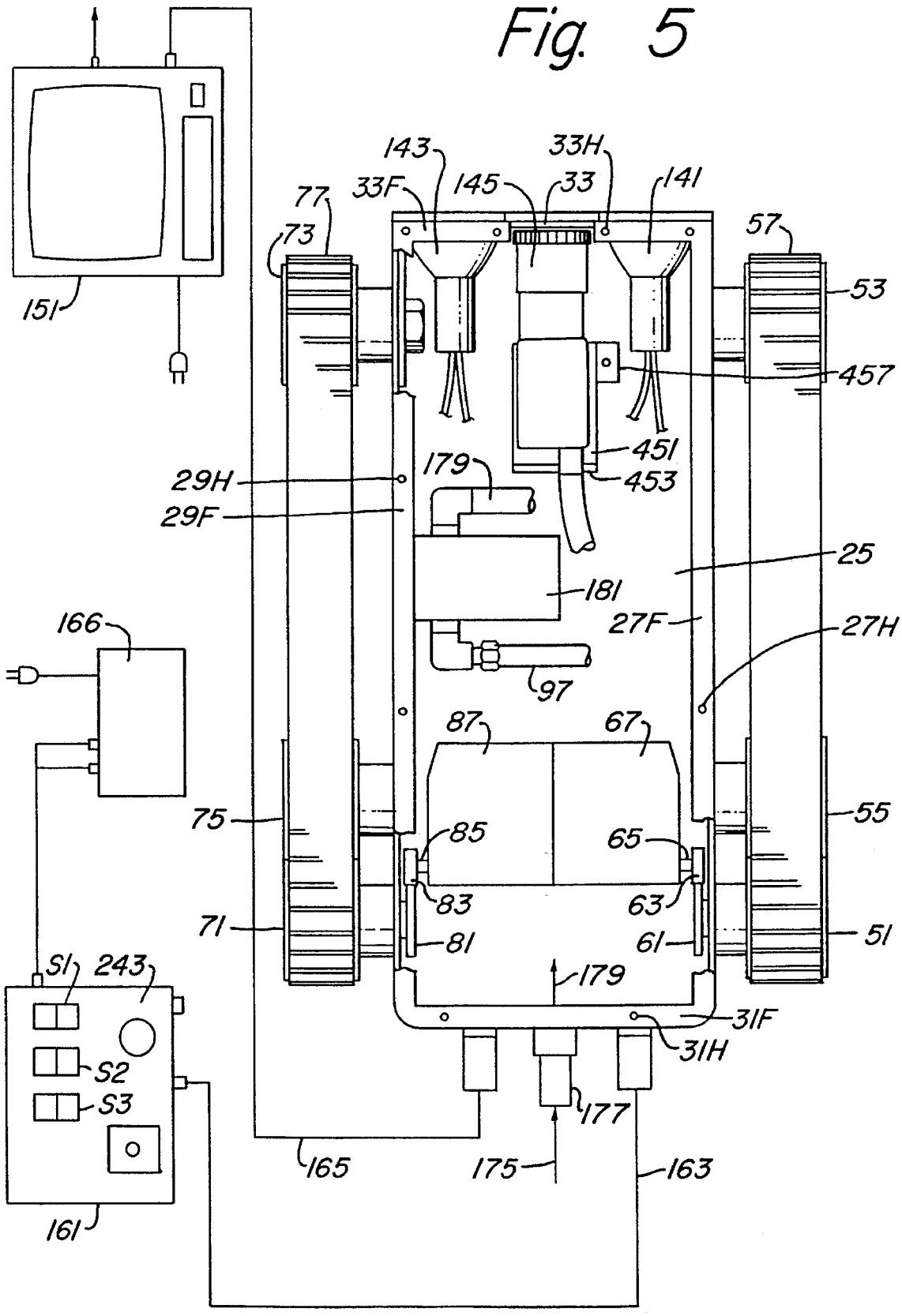
FIG. 5 is a top view of the apparatus of FIG. 1 with its top cover removed and also showing remote controlled drive motors, remote controlled lights and a camera, and a remote controlled valve for controlling the flow of compressed air to the cleaning means.
Figures 15A, 15B, 15C:
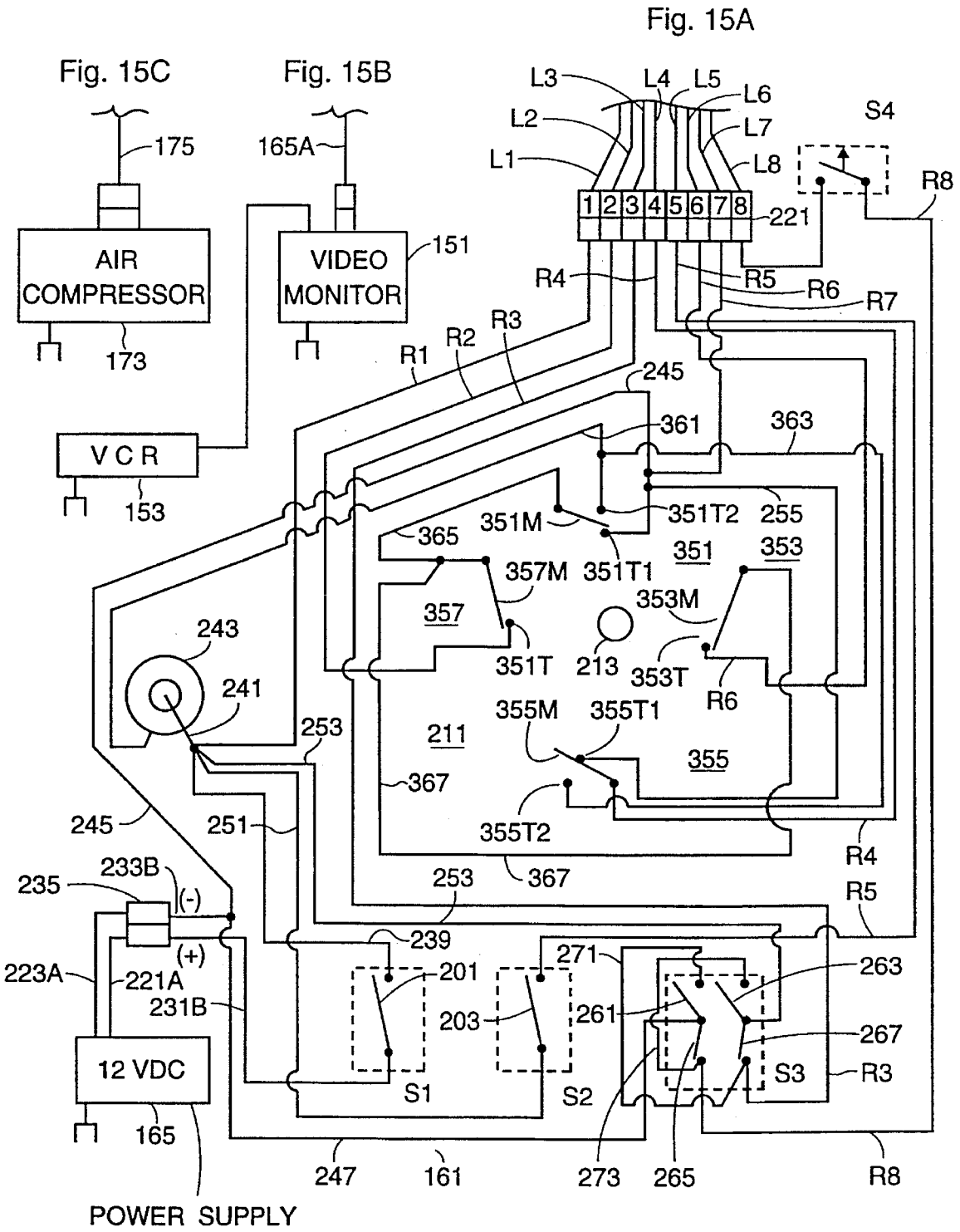
FIGS. 15A, 15B, and 15C are a schematic of the components and circuitry located at a remote position for controlling the components and circuitry of FIG. 14.

Two electrical lights 141 and 143 and an electrical video camera 145 are supported in the body 23, 35 at the front end to allow the inside of the duct to be illuminated and monitored by way of a remote monitor and VCR shown at 151 and 153 in FIG. 5 and 15B. The VCR 153 allows records of the inspection of the inside of the duct to be made if desired.

Figure 14:
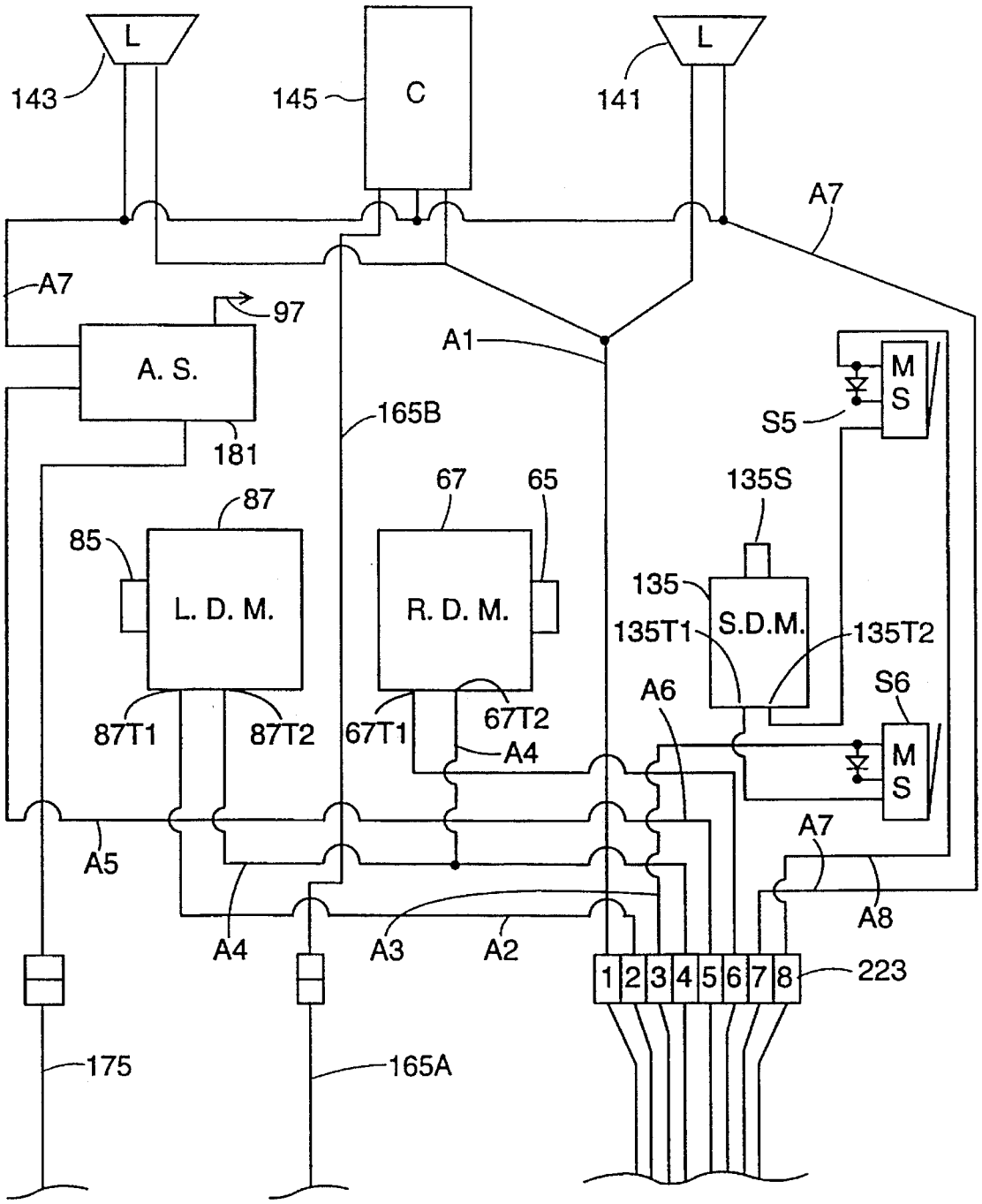
FIG. 14 is a schematic of the components and circuitry supported by the apparatus of FIG. 1.

Electrical power to the left and right drive motors 67 and 87, and to the scissors motor 135, the lights 141 and 143, and the video camera 145 and is provided from a remote control system 161 by way of an elongated bundle of electrical leads 163. A co-axial cable 165 extends from the camera 145 to the video monitor 151. Member 166 is an AC to DC converter for applying DC voltage to the system 161 such that a low DC voltage is used to operate the components 67, 87, 141, 143, and 145, 135 and 181 for safety purposes to the personnel using the apparatus. Air under pressure is applied from a remote air compressor 173 (See FIGS. 14 and 15A) to the apparatus 21 by way of a flexible tube 175 which is connected to a fitting 177. A tube 179 is connected to fitting 177 and to an air control solenoid valve 181 to which electrical power is applied to control the flow of pressurized air to conduit 97.

Referring now to FIGS. 14 and 15A, 15B and 15C there will be described the remote electrical control system 161 and the electrical system in the apparatus 21.

Switch S1 controls electrical power to the system 161 and apparatus 21 including power to the lights 141 and 143 and to the camera 145. Normally its switch member 201 is an open position. Switch S2 controls electrical power to the air solenoid valve 181. Normally its switch member 203 is in an open position. Switch S3 controls electrical power to the scissors motor 135. Switch 211 is a joy stick switch having a joy stick 213 for controlling electrical power to the right and left drive motors 67 and 87. Switch S4 is a normally open push button switch located at the System 161.

In the system 161 the leads R1–R8 extends to a connector 221 and are connected to corresponding leads L1–L8 of the bundle 163. Elongated leads L1–L8 extends to a connector 223 and are connected to corresponding leads A1–A8 of the apparatus 21.

Preferably the DC power supply 166 produces 12 volts DC although the DC power supply used may provide a different level of DC. The plus and minus leads 221A and 223A are connected to leads 231B and 233B respectively by way of a connector 235. Plus lead 231B is connected to normally open switch member 201 which when closed contacts lead 239 which is connected to the input 241 of a rheostat 243. Minus lead 233B is connected to a lead 245 and to a lead 247.

When switch S1 is closed, 12 volts DC is applied to lead 239 to lead 241 and to leads 251, 253, and R1. At the same time a minus voltage is applied to leads 245 and 247. From lead 245, the minus voltage is applied to lead R7 and to lead 255. Thus a plus voltage is applied by way of leads L1 and A1 to the lights 141 and 143 and to the camera 145 and a minus voltage is applied by way of leads R7, L7, and A7 to the lights 141, and 143 and to the camera 145 to energize these components.

A minus DC voltage also is applied to the air solenoid 181 by way of lead A7. When switch member 203 of switch S2 is closed, a plus DC voltage is applied to lead R5 and by way of leads L5 and A5 to the air solenoid 181 to open the valve of the solenoid to allow air under pressure to flow to tube 97. The valve of solenoid 181 is normally closed.

Switch S3 includes two normally open ganged switch members 261 and 263 and two normally closed ganged switch member 265 and 267. When switch members 261 and 263 are open, switch members 265 and 267 are closed. When switch members 261 and 263 are closed, switch members 265 and 267 are open. A minus DC voltage is applied to switch members 261 and 265 by way of lead 247 and by way of switch member 265 to lead R8 (when normally open switch S4 is closed) and by way of leads L8 and A8 to normally closed microswitch S5 and to terminal 135T2 of the scissors drive motor 135. At the same time, a plus DC plus voltage is applied by way of lead 253 to closed switch 267 to lead R3 and by way of leads L3 and A3 to normally closed microswitch S6 and to terminal 135T1 of the scissors drive motor 135 causing the motor 135 to rotate its threaded shaft 135S in a given direction to elevate the platform 131.

When normally open switches 261 and 263 are closed and normally closed switches 265 and 267 are open, the motor 135 rotates its shaft 135S in an opposite direction to lower the platform 131. In this respect minus DC voltage is applied by way of lead 247 to closed switch member 261 to lead 271 and to lead R3. From lead R3 the minus DC voltage is applied to lead L3 and then to lead A3 and by way of normally closed microswitch S6 to input terminal 135T1 of the motor 135. At the same time, a DC plus voltage is applied by way of lead 253, closed switch 263 and lead 273 to lead R8. When switch S4 is closed, the voltage is applied by way of leads L8 and A8 to normally closed microswitch S5 to the terminal 135T2 of the motor 135 to rotate its shaft 135S in a direction to lower the support 131.

Figure 8:
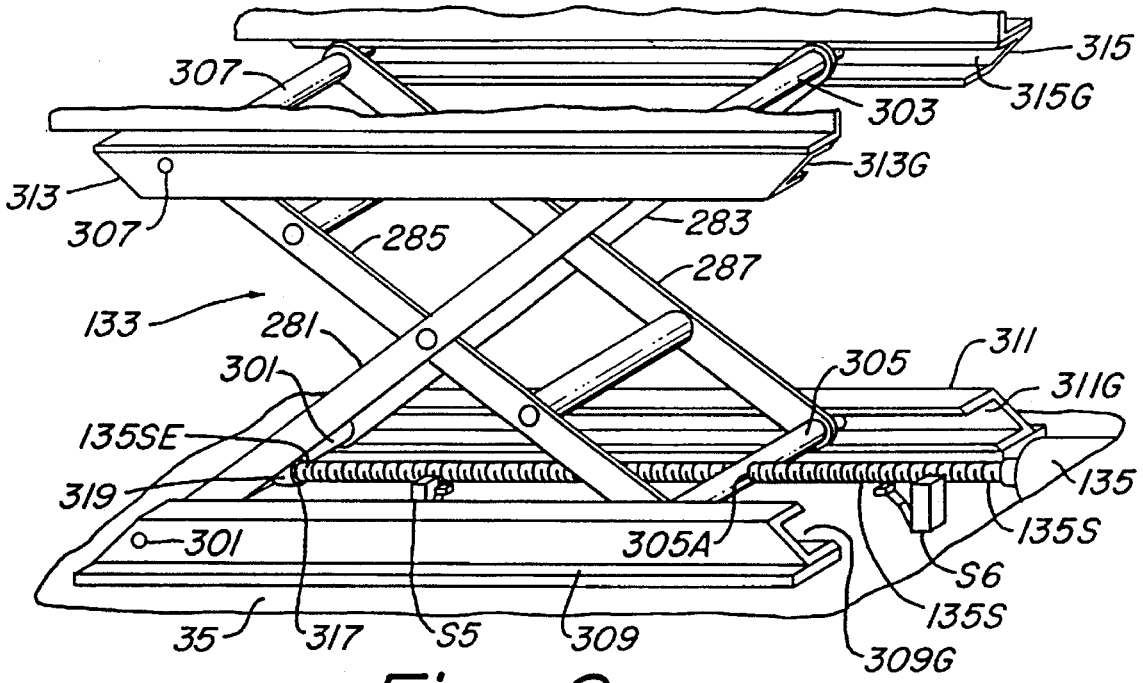
FIG. 8 is an isometric view of a portion of the cleaning mechanism support device of FIG. 6.
Figure 9:
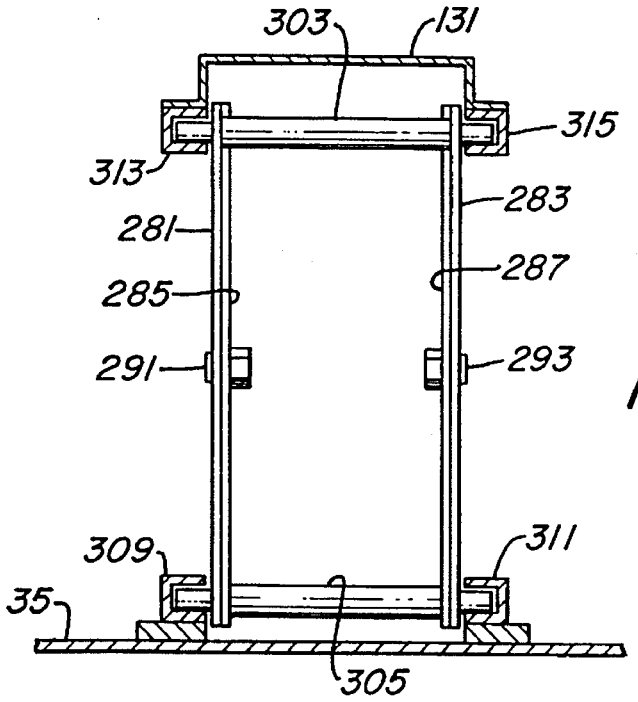
FIG. 9 is a rear view of the support device of FIG. 8.
Figure 11:
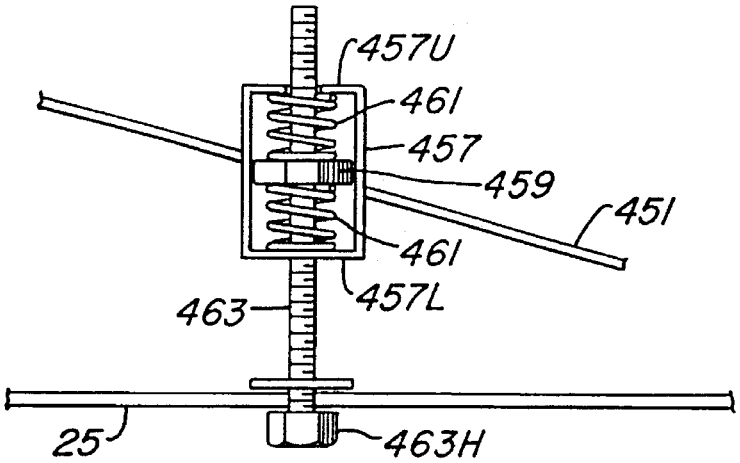
FIG. 11 is a partial cross-sectional view of the mechanism of FIG. 10.
Figure 10:
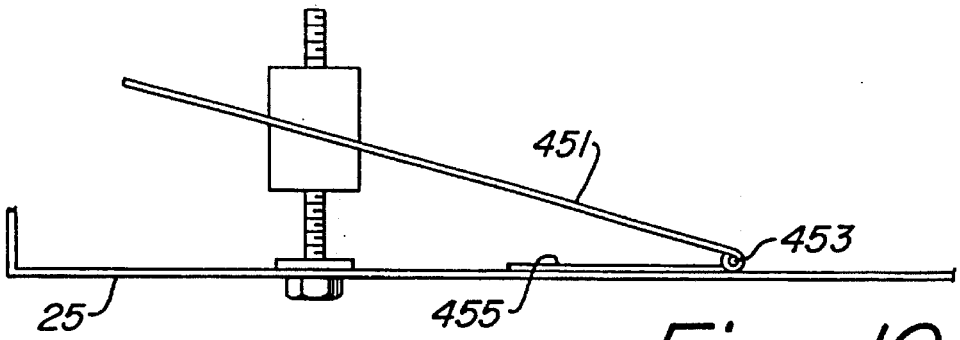
FIG. 10 is a side view of a mechanism for allowing manual elevational adjustment of the video camera supported by the apparatus of FIG. 1.
Figure 12:
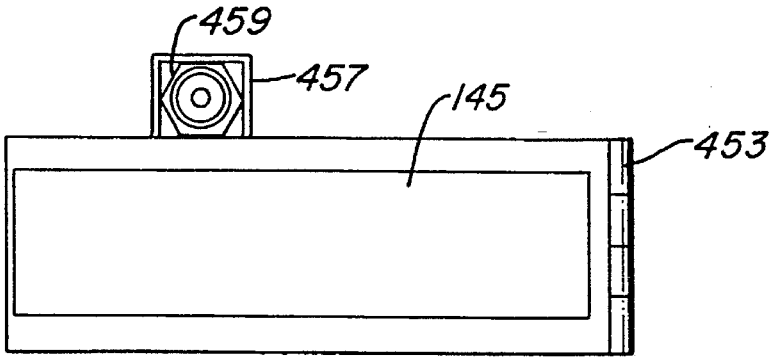
FIG. 12 is a top view of the mechanism of FIGS. 10 and 11.

Referring also to FIGS. 8 and 9, the scissors mechanism 133 for raising and lowering the support 131 comprises two parallel legs 281 and 283 and two parallel legs 285 and 287. Legs 281 and 285 are pivotally coupled together by a rod 291 and legs 283 and 287 are pivotally coupled together by a rod 293. Rods 301 and 303 rotatably extend through apertures formed though the lower and upper ends of legs 281 and 283 and rods 305 and 307 rotatably extend through apertures formed through the lower and upper ends of legs 285 and 287. The opposite outer ends of rods 301 and 305 are located in elongated grooves 309G and 311G of members 309 and 311 which are fixed to the top plate 35 of the apparatus 21. The opposite outer ends of rods 303 and 307 are located in elongated grooves 313G and 315G of members 313 and 315 which are secured to the support 131. The rods 301 and 307can turn in the grooves 309G, 311G and 313G, 315G but cannot slide in the grooves. Their outer ends are located in the apertures formed through members 309, 311 and 313, 315. The outer opposite outer ends of rods 303 and 305 can slide in the grooves 309G, 311G and 313G, 315G respectively. Threaded shaft 135S is screwed through a threaded aperture 305A formed through rod 305. The end 135SE of the shaft 135S is rotatably located in an aperture 317 of member 319 which is secured to rod 301. Thus rotation of the shaft 135S in one direction causes the rod 305 to move from right to left as seen in FIG. 8. and hence the rod 303 to move from right to left to raise the support 131. When the rod 305 engages the switch S5 it opens the switch to terminate further movement to the left. Rotation of the shaft 135S in an opposite direction causes the rod 305 to move from left to right as seen in FIG. 8 and hence the rod 303 to move from left to right to lower the support 131. When the rod 305 engages the switch S6, it opens the switch to terminate further movement to the right.

Thus when switches S1 and S4 are closed. switch S3 can be operated to raise or lower the cleaning device support 131.

The joy stick switch 211 comprises a movable joy stick 213 and four microswitches 351, 353, 355, and 357 having movable switch members 351M, 353M, 355M and 357M. Member 351M normally engages terminal 351T1 and can be moved by the joy stick 213 to engage terminal 351T2. Member 353M normally engages terminal 353T and can be moved by the joy stick 213 to an open position. Member 355M normally engages terminal 355T1 and can be moved by the joy stick 213 to engage terminal 355T2. Member 357M normally engages terminal 357T and can be moved by the joy stick 213 to an open position.

If the operator wants to move the apparatus 21 forward, the joy stick 213 is moved to cause switch member 351M to engage terminal 351T2. The positive voltage output of the rheostat 243 is applied to terminal 351T2 by way of lead 361 and to terminal 355T2 by way also of lead 363. When member 351M engages terminal 351T2, the output of the rheostat is applied to lead 365 to switch member 357M and lead R2 and to lead 367 switch member 353M and lead R6. Lead R2 is connected to lead L2 and hence to lead A2 which is connected to terminal 87T1 of motor 87. Lead R6 is connected to lead L6 hence to lead A6 which is connected to terminal 67T1 of motor 67. A minus DC voltage is applied to lead R4 by way of leads 245, 255, and switch member 355M. Lead R4 is connected to terminals 87T2 and 67T2 of motors 87 and 67 by way of L4 and A4. This causes both motors 87 and 67 to operate to drive their wheels 71 and 51 in a direction to move the apparatus forward.

While the joy stick is holding switch member 351M against terminal 351T2, the joy stick 213 can be moved to the left to open switch member 357M to cause the apparatus 21 to turn left or moved to the right to open switch member 353M to cause the apparatus 21 to turn right. In this respect, if switch member 357M is opened while switch member 351M engages terminal 351T2, power to lead R2 and hence to leads L2 and A2 and to motor terminal 87T1 is disconnected. This causes only motor 67 to operate to rotate wheel 51 to cause the apparatus 21 to turn to the left.

If switch member 353M is opened while switch member 351M engages terminal 351T2, power to lead R6 and hence to leads L6 and A6 and to motor terminal 67T1 is disconnected. This causes only motor 87 to operate to rotate wheel 71 to cause the apparatus 21 to turn to the right.

If the operator wants to move the apparatus 21 rearward, the joy stick 213 is moved to cause switch member 355M to engage terminal 355T2. The output from the rheostat 243 is applied to lead 361, lead 363, terminal 355T2, switch member 355M and lead R4, lead L4, lead A4 and motor terminals 67T2 and 87T2. Minus DC voltage is applied to motor terminal 67T1 by way of lead 245, switch member 351M, lead 365, lead 367, switch member 353M, lead R6, lead L6, and lead A6 and to motor terminal 87T1 by way of lead 245, switch member 351M, lead 365, switch member 357M, lead R2, lead L2, and lead A2. Thus both motors 67 and 87 are operated to drive their wheels 51 and 71 in a direction to move the apparatus 21 rearward.

While the joy stick 213 is holding switch member 355M against terminal 355T2, the joy stick 213 can be moved to the left to open switch member 357M to cause the apparatus 21 to turn right or moved to the right to open switch member 353M to cause the apparatus 21 to turn left. In this respect, if switch member 357M is opened while switch member 355M engages terminal 355T2, minus DC voltage to lead R2 and hence to leads L2 and A2 and to motor terminal 87T1 is disconnected. This causes only motor 67 to operate to rotate wheel 51 to cause the apparatus 21 to turn to the right.

If switch member 353M is opened while switch member 355M engages terminal 355T2, minus DC voltage to lead R6, and hence to leads L6 and A6 and to motor terminal 67T1 is disconnected. This causes only motor 87 to operate to rotate wheel 71 to cause the apparatus to turn left.

Figure 6:
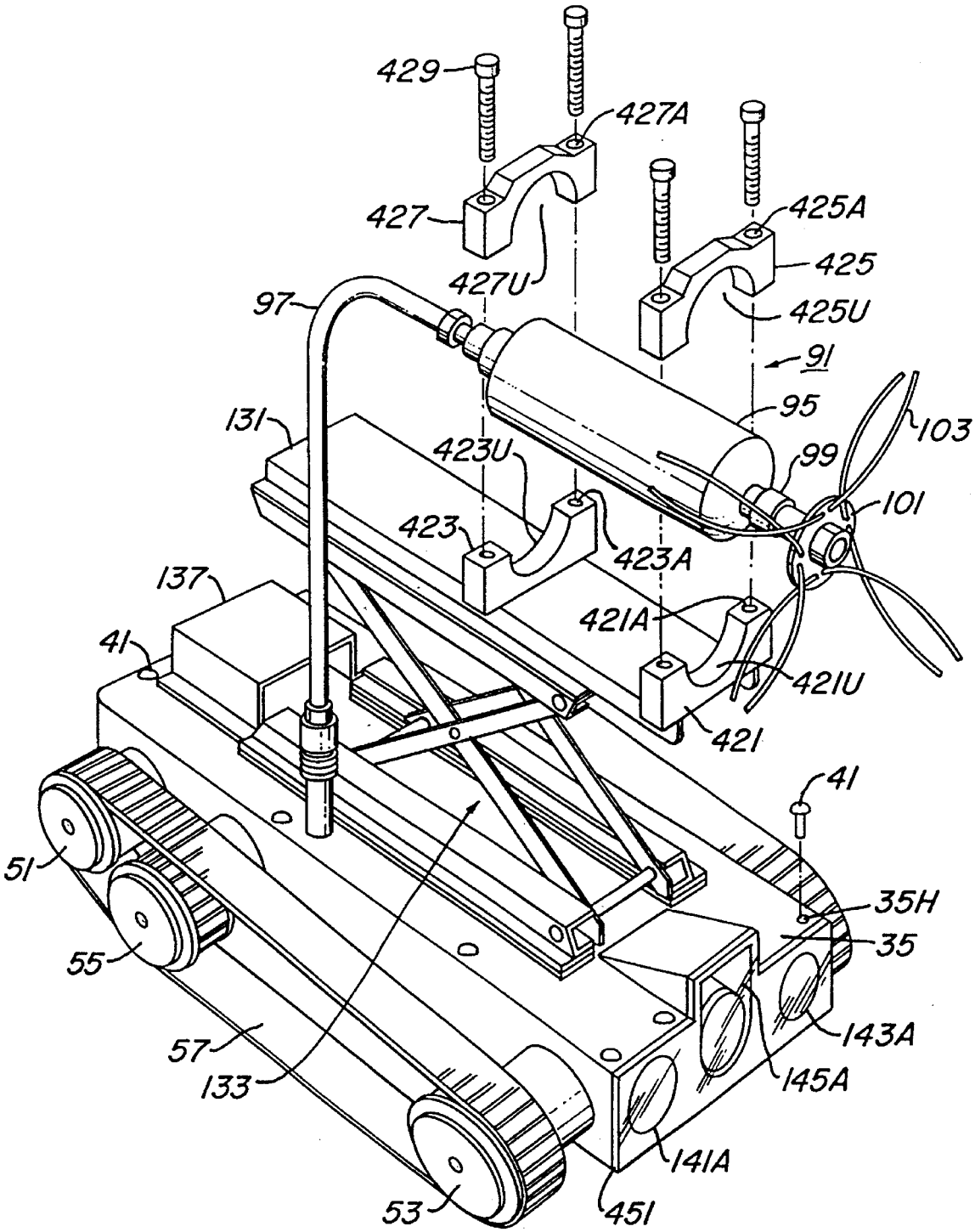
FIG. 6 illustrates the cleaning mechanism support device in an elevated position.
Figure 7:
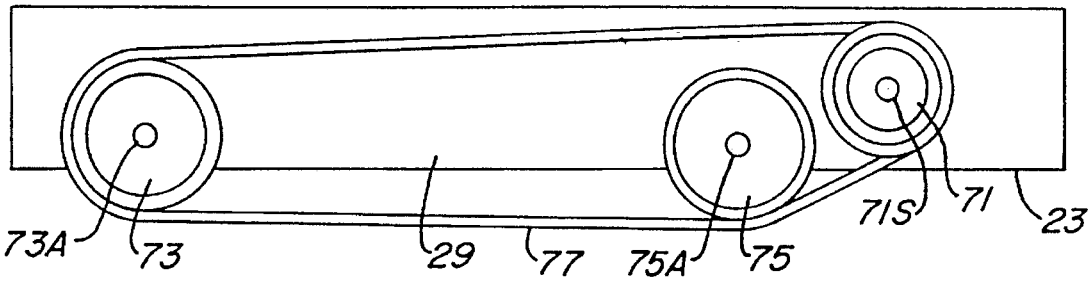
FIG. 7 is a partial left side view of the apparatus of FIG. 1.

Referring to FIG. 6, the cleaning device 91 is removably coupled to the support 131 with two U shaped members 421 and 423 secured to the support 131 and two removable U shaped members 425 and 427 and bolts 429. In this respect the lower portion of the cylindrical body 95 of the air motor is located in the openings 421U and 423U of the members 421 and 423 and the walls forming the openings 425U and 427U of the members 425 and 427 are located around the upper portion of the body 95 and the bolts 429 are extended through the apertures 425A and 427A of members 425 and 427 and screwed into threaded apertures 421A and 423A of members 421 and 423 to removably secure the air motor 95 to the support 131.

Referring to FIG. 13, the cleaning device 93 of FIG. 13 is removably held in place by two wing shaped clamps 431 and 433 with C-shaped holders 435 and 437 to fit around the tubular member 121 and bolts 429 which are inserted through apertures 431A and 433A and screwed into apertures 421A and 423A of members 421 and 423.

As an alternative, the head 123 may be removed from the tube 121 to allow only air to be blown into the duct from the tube 121 to "sweep" dust from the duct which has been loosened for example by the cleaning device 91.

Instead of using an air driven motor 95 for rotating the shaft 99, holder 101 and lines 103, an electric motor could be used although the power source 165 would have to produce more voltage than 12 volts. In this alternative, separate electrical leads would extend from the system 161 to the apparatus 21 for operating the electric motor for the cleaner.

Referring to FIG. 6, the front wall 33 of the apparatus 21 has two openings 141A and 143A for allowing the light beams from the lights 141 and 143 to pass through and an opening 145A for passage of light to the camera 145. A transparent plate 451 is secured to the front wall 33.

The camera opening 145A has a vertical dimension greater than that of the camera 145 to allow the camera to be raised if desired. As shown in FIGS. 5 and 10–12 the camera 145 is secured to a plate 451 which is hinged at 453 to a lower plate 455 to allow the front of the plate 451 to be raised or lowered. The lower plate 455 is secured to the bottom wall 25 of the member 23. Secured to the plate 451 on one side is a box 457 having a nut 459 with springs 461 on opposite sides. The nut 459 cannot rotate in the box but can move up and down in the box against the springs 461. A bolt 463 extends through an aperture formed through lower wall 457L of the box, is screwed through the nut 459 and extends through an aperture formed through the upper wall 457U of the box 457. By manually turning the head 463U of the nut 463, the box 457 and hence the plate 451 and camera 145 can be raised or lowered.

In one embodiment the air motor 95 is a model No. 2Z491 motor available commercially from Dayton. The joy stick switch 203 is a model No. 15K25-2 device available commercially from Dunham. The camera 145 is a model No. 902 camera available commercially from Watec. The video monitor 151 is a model No. KM-9 monitor available commercially from Ultrak.

In one embodiment, the apparatus 21 has a height of about 6 inches, a length of about 15 inches, and a width of about 9 inches. It is to be understood that the apparatus 21 could have different dimensions than those listed herein. With a 12 volt DC power source, it may have a lead bundle 163 of about 55 feet between the apparatus 21 and the power system 161. With a 15 volt power source, the lead bundle 163 may have a length of about 80 feet. In using the apparatus 21 in one example, with the cleaning device 91, the apparatus 21 may be sent down the duct with the air motor 95 operating to rotate the strings 103 while drawing a vacuum at the other end of the duct. The apparatus 21 may then be backed out and sent down the duct with the modified apparatus 93 with the head 123 removed and air blown from the tube 121 for "sweeping" purposes while a vacuum is drawn from the other end of the duct.

I claim:

1. An apparatus for use for cleaning ducts, comprising:

a body to be located in a duct, wheels coupled to said body for use for moving said body in the duct, electrical power means supported by said body coupled to said wheels for rotating said wheels for moving said body, cleaning means supported by said body for providing a cleaning function for cleaning the inside wall of a duct, an inlet supported by said body and coupled to said cleaning means for receiving air under pressure for use for allowing said cleaning means to provide said cleaning function, an electrical air control apparatus supported by said body for opening and closing said inlet, a DC power supply and a source of air under pressure located at a remote control system, a plurality of electrical leads extending between said remote control system and said body, said plurality of electrical leads comprises at least two electrical power control leads coupled to said electrical power means and at least one electrical control apparatus lead coupled to said electrical air control apparatus, an air control apparatus switch located at said remote control system for coupling and uncoupling said one electrical control apparatus lead to and from said DC power supply, a wheel control switching system located at said remote control system for coupling and uncoupling said two electrical power control leads to and from said DC power supply, and a conduit extending between said remote control system and said body and coupled to said source of air at said remote control system and to said inlet at said body for supplying air to said inlet.

2. The apparatus of claims 1, wherein:

said body has front and rear ends and two opposite sides, said plurality of electrical leads comprises an additional electrical power control lead coupled to said electrical power means and extending to said remote control system, said wheel control switching system comprises circuitry for coupling said DC power supply to said electrical power control leads to operate said electrical power means in a mode to cause said wheels to move said body in a forward direction,

3. The apparatus of claim 1, wherein:

said body has front and rear ends and two opposite sides, said plurality of electrical leads comprises an additional electrical power control lead coupled to said electrical power means and extending to said remote control system, said wheel control switching system comprises circuitry for coupling said DC power supply to said electrical power control leads to operate said electrical power means in a mode to cause said wheels to move said body in a rearward direction.

4. The apparatus of claim 1, wherein:

said body has front and rear ends and two opposite sides, said plurality of electrical leads comprises an additional electrical power control lead coupled to said electrical power means and extending to said remote control system, said wheel control switching system comprises circuitry for coupling said DC power supply to said electrical power control leads to operate said electrical power means in first and second modes to cause said wheels to move in first and second opposite directions to cause said body to move in forward and rearward directions respectively.

5. The apparatus of claim 4, wherein:

said wheels comprise a driven wheel located on each of said opposite sides of said body, said electrical power means comprises two motors each for driving a respective one of said driven wheels, said wheel control switching system comprises circuitry for coupling said DC power supply to said electrical power control leads to cause said electrical power means to operate said first and second motors independently of each other for causing said body to turn.

6. The apparatus of claim 4, comprising:

an electrical light supported at said front end of said body, a video camera supported at said front end of said body, a video display screen electrically coupled to said video camera, said plurality of electrical leads comprises two light and camera control leads coupled to said light and camera and extending to said remote control system, a light and camera control switch located at said remote control system for coupling and uncoupling said two light and camera control leads to and from said DC power supply.

7. The apparatus of claim 5, comprising:

an electrical light supported at said front end of said body, a video camera supported at said front end of said body, a video display screen electrically coupled to said video camera, said plurality of electrical leads comprises two light and camera control leads coupled to said light and camera and extending to said remote control system, a light and camera control switch located at said remote control system for coupling and uncoupling said two light and camera control leads to and from said DC power supply.

8. The apparatus of claim 4, comprising:

a support for supporting said cleaning means, movable means for moving said support upward and downward relative to said body, an electrical support control motor for causing said movable means to move said support upward and downward relative to said body, said plurality of electrical leads comprises two electrical motor support control leads coupled to said electrical support control motor and extending to said remote control system, and a support control switch located at said remote control system for coupling said two electrical motor support control leads to said DC power supply in first and second modes to cause said support motor to raise and lower said support upward and downward relative to said body.

9. The apparatus of claim 5, comprising:

a support for supporting said cleaning means, movable means for moving said support upward and downward relative to said body, an electrical support control motor for causing said movable means to move said support upward and downward relative to said body, said plurality of electrical leads comprises two electrical motor support control leads coupled to said electrical support control motor and extending to said remote control system, and a support control switch located at said remote control system for coupling said two electrical motor support control leads to said DC power supply in first and second modes to cause said support motor to raise and lower said support upward and downward relative to said body.

10. The apparatus of claims 1, wherein:

said body has front and rear ends and two opposite sides, said wheels comprise a driven wheel located on each of said opposite sides of said body, said electrical power means comprises two motors each for driving a respective one of said driven wheels, said plurality of electrical leads comprises an additional electrical power control lead coupled to said electrical power means and extending to said remote control system, said wheel control switching system comprises circuitry for coupling said DC power supply to said electrical power control leads to cause said electrical power means to operate said first and second motors independently of each other for causing said body to turn.

11. The apparatus of claim 1, wherein:

said body has front and rear ends and two opposite sides, an electrical light supported at said front end of said body, a video camera supported at said front end of said body, a video display screen electrically coupled to said video camera, said plurality of electrical leads comprises two light and camera control leads coupled to said light and camera and extending to said remote control system, a light and camera control switch located at said remote control system for coupling and uncoupling said two light and camera control leads to and from said DC power supply.

12. The apparatus of claim 1, comprising:

a support for supporting said cleaning means, movable means for moving said support upward and downward relative to said body, an electrical support control motor for causing said movable means to move said support upward and downward relative to said body, said plurality of electrical leads comprises two electrical motor support control leads coupled to said electrical support control motor and extending to said remote control system, and a support control switch located at said remote control system for coupling said two electrical motor support control leads to said DC power supply in first and second modes to cause said support motor to raise and lower said support upward and downward relative to said body.

13. An apparatus for use for cleaning ducts, comprising:

a body to be located in a duct, wheels coupled to said body for use for moving said body in the duct, electrical power means supported by said body coupled to said wheels for rotating said wheels for moving said body, cleaning means supported by said body for providing a cleaning function for cleaning the inside wall of a duct, an inlet coupled to said cleaning means for receiving air under pressure for use for allowing said cleaning means to provide said cleaning function, electrical leads coupled to said electrical power means for supplying electrical power to said electrical power means for rotating said wheels for moving said body, a conduit coupled to said inlet for supplying air under pressure to said cleaning means, a support for supporting said cleaning means, movable means for moving said support upward and downward relative to said body, and an electrical motor for causing said movable means to move said support upward and downward relative to said body.

14. An apparatus for use for cleaning ducts, comprising:

a body to be located in a duct, wheels coupled to said body for use for moving said body in the duct, electrical power means supported by said body coupled to said wheels for rotating said wheels for moving said body, cleaning means supported by said body for providing a cleaning function for cleaning the inside wall of a duct, an inlet coupled to said cleaning means for receiving air under pressure for use for allowing said cleaning means to provide said cleaning function, electrical leads coupled to said electrical power means for supplying electrical power to said electrical power means for rotating said wheels for moving said body, a conduit coupled to said inlet for supplying air under pressure to said cleaning means, said body has front and rear ends and two opposite sides, circuitry coupled to said electrical power means for causing said wheels to move in first and second opposite directions to cause said body to move forward and rearward directions respectively, a support for supporting said cleaning means, movable means for moving said support upward and downward relative to said body, and an electrical motor for causing said movable means to move said support upward and downward relative to said body.

15. An apparatus for use for cleaning ducts, comprising:

a body to be located in a duct, wheels coupled to said body for use for moving said body in the duct, electrical power means supported by said body coupled to said wheels for rotating said wheels for moving said body, cleaning means supported by said body for providing a cleaning function for cleaning the inside wall of a duct, an inlet coupled to said cleaning means for receiving air under pressure for use for allowing said cleaning means to provide said cleaning function, electrical leads coupled to said electrical power means supplying electrical power to said electrical power means for rotating said wheels for moving said body, a conduit coupled to said inlet for supplying air under pressure to said cleaning means, said body has front and rear ends and two opposite sides, circuitry coupled to said electrical power means for causing said wheels to move in first and second opposite directions to cause said body to move in forward and rearward directions respectively, said wheels comprise a drive wheel located on each of said opposite sides of said body, said electrical power means comprises first and second drive motors for driving a respective one of said drive wheels, an electrical control system for independently operating each of said first and second drive motors for causing said body to turn, a support for supporting said cleaning means, movable means for moving said support upward and downward relative to said body, and an electrical motor for causing said movable means to move said support upward and downward relative to said body.

16. The apparatus of claim 15, comprising:

an electrical light supported at said front end of said body, a video camera supported at said front end of said body, a video display screen electrically coupled to said video camera, electrical circuitry for operating said light and said camera for providing a display of the inside of the duct on said screen.

17. The apparatus of claim 15, comprising:

an electrical light supported at said front end of said body, a video camera supported at said front end of said body, a video display screen electrically coupled to said video camera, said plurality of electrical leads comprises two light and camera control leads coupled to said light and camera and extending to said electrical control system, a light and camera control switch located at said electrical control system for coupling and uncoupling said two light and camera control leads to and from said DC power supply.

18. An apparatus for use for cleaning ducts, comprising:

a body to be located in a duct, cleaning means supported by said body for providing a cleaning function for cleaning the inside wall of a duct, wheels coupled to said body for use for moving said body in the duct, said body has front and rear ends and two opposite sides, said wheels comprise a driven wheel located on each of said opposite sides of said body, two electrical motors supported by said body each for driving a respective one of said driven wheels, a DC power supply located at a remote control system, a plurality of electrical leads extending between said remote control system and said body, said plurality of electrical leads comprises at least two electrical power control leads coupled to said two electrical motors respectively, a wheel control switching system at said remote control system for coupling and uncoupling said two electrical power control leads to and from said DC power supply.

19. The apparatus of claim 18, comprising:

an electrical light supported at said front end of said body, a video camera supported at said front end of said body, a video display screen electrically coupled to said video camera, said plurality of electrical leads comprises two light and camera control leads coupled to said light and camera and extending to said remote control system, a light and camera control switch located at said remote control system for coupling and uncoupling said two light and camera control leads to and from said DC power supply.

20. The apparatus of claim 18, comprising:

a support for supporting said cleaning means, movable means for moving said support upward and downward relative to said body, an electrical support control motor for causing said movable means to move said support upward and downward relative to said body, said plurality of electrical leads comprises two electrical motor support control leads coupled to said electrical support control motor and extending to said remote control system, and a support control switch located at said remote control system for coupling said two electrical motor support control leads to said DC power supply in first and second modes to cause said support motor to raise and lower said support upward and downward relative to said body.

21. An apparatus for use for cleaning ducts, comprising:

a body to be located in a duct, wheels coupled to said body for use for moving said body in the duct, electrical power means supported by said body coupled to said wheels for rotating said wheels for moving said body, cleaning means for providing a cleaning function for cleaning the inside wall of a duct, a support for supporting said cleaning means, movable means for moving said support upward and downward relative to said body, and an electrical motor for causing said movable means to move said support upward and downward relative to said body, electrical leads coupled to said electrical power means and to said electrical motor for supplying electrical power to said electrical power means and to said electrical motor.

22. An apparatus for use for cleaning ducts, comprising;

a body to be located in a duct, wheels coupled to said body for use for moving said body in the duct, electrical power means supported by said body coupled to said wheels for rotating said wheels for moving said body, cleaning means supported by said body for providing a cleaning function for cleaning the inside wall of a duct, said body has front and rear ends and two opposite sides, an electrical light supported at said front end of said body, a video camera supported at said front end of said body, a video display screen electrically coupled to said video camera, a DC power supply located at a remote control system, a plurality of electrical leads extending between said remote control system and said body.

said plurality of electrical leads comprises two light and camera control leads coupled to said light and camera and extending to said remote control system, a light and camera control switch located at said remote control system for coupling and uncoupling said two light and camera control leads to and from said DC power supply.

23. An apparatus for use for cleaning ducts, comprising:

a body to be located in a duct, cleaning means supported by said body for providing a cleaning function for cleaning the inside wall of a duct, wheels coupled to said body for use for moving said body in the duct, said body has front and rear ends and two opposite sides, two electrical motors supported by said body each for driving a respective one of said wheels, an electrical control system for causing said wheels to move in forward and rearward directions respectively and for independently operating each of said motors for causing said body to turn, electrical leads coupled between said electrical control system and said two motors for supplying electrical power to said two motors, support means for supporting said cleaning means, movable means for moving said support means upward and downward relative to said body, and an electrical motor coupled to electrical leads for causing said movable means to move said support means upward and downward relative to said body.

24. The apparatus of claim 23, comprising:

an electrical light supported at said front end of said body, a video camera supported at said front end of said body, a video display screen electrically coupled to said video camera, electrical circuitry comprising electrical leads for operating said light and said camera for providing a display of the inside of the duct on said screen.

25. The apparatus of claim 24, comprising:

clamp means for removably coupling said cleaning means to said support means.

26. The apparatus of claim 23, comprising:

an electrical light supported at said front end of said body, a video camera supported at said front end of said body, a video display screen electrically coupled to said video camera, said plurality of electrical leads comprises two light and camera control leads coupled to said light and camera and extending to said electrical control system, a light and camera control switch located at said electrical control system for coupling and uncoupling said two light and camera control leads to and from a DC power supply.

* * * * *